US010722010B2

(12) United States Patent
D'Jay

(10) Patent No.: US 10,722,010 B2
(45) Date of Patent: Jul. 28, 2020

(54) SYSTEMS AND METHODS FOR ADJUSTABLE LENGTH WEIGHTED TREKKING POLES

(71) Applicant: Douglas J. D'Jay, Ridgefield, CT (US)

(72) Inventor: Douglas J. D'Jay, Ridgefield, CT (US)

(73) Assignee: Douglas J. D'Jay, Ridgefield, CT (US)

( * ) Notice: Subject to any disclaimer, the term of this patent is extended or adjusted under 35 U.S.C. 154(b) by 0 days.

(21) Appl. No.: 16/455,231

(22) Filed: Jun. 27, 2019

(65) Prior Publication Data

US 2020/0029662 A1 Jan. 30, 2020

Related U.S. Application Data

(60) Provisional application No. 62/711,835, filed on Jul. 30, 2018.

(51) Int. Cl.

| | |
|---|---|
| ***A45B 1/00*** | (2006.01) |
| ***A45B 9/02*** | (2006.01) |
| ***A45F 4/00*** | (2006.01) |
| ***A45F 3/18*** | (2006.01) |
| *A45B 9/00* | (2006.01) |

(52) U.S. Cl.

CPC ..... *A45B 1/00* (2013.01); *A45B 9/02* (2013.01); *A45F 3/18* (2013.01); *A45F 4/00* (2013.01); *A45B 2009/007* (2013.01)

(58) Field of Classification Search

CPC ..... A45B 2009/007; A45B 3/00; A63B 15/00; A63B 21/072

USPC ..... 135/68, 65; 482/74, 93, 109

See application file for complete search history.

(56) References Cited

U.S. PATENT DOCUMENTS

| | | | | |
|---|---|---|---|---|
| 4,037,850 | A | 7/1977 | Haberlin | |
| 4,613,156 | A | 9/1986 | Lajos | |
| 4,645,235 | A | 2/1987 | Joseph | |
| 4,664,373 | A | 5/1987 | Hait | |
| 4,688,788 | A | 8/1987 | Olufs | |
| 4,756,524 | A | 7/1988 | Cooney | |
| RE33,218 | E | 5/1990 | Twardosz | |
| 5,139,040 | A * | 8/1992 | Kelly | A61H 3/02 135/69 |
| 5,265,307 | A | 11/1993 | Hull et al. | |

(Continued)

FOREIGN PATENT DOCUMENTS

| | | |
|---|---|---|
| AU | 2012101787 | 1/2013 |
| CA | 2794729 | 10/2011 |

(Continued)

OTHER PUBLICATIONS

Office Action of U.S. Appl. No. 15/480,680 dated Nov. 17, 2017; 9 pps.

(Continued)

*Primary Examiner* — Noah Chandler Hawk

(74) *Attorney, Agent, or Firm* — Carson C. K. Fincham; Fincham Downs LLC

(57) ABSTRACT

Systems, methods, and articles of manufacture for adjustable length, multi-segment, weighted trekking pole are provided. Two or three-segment trekking (or other) poles may benefit from removable slotted annular-shaped weights that may provide liquid storage and may be configured to fit around the pins of a pin-and-hole coupling mechanism that attaches the pole segments together.

20 Claims, 5 Drawing Sheets

(56) References Cited

U.S. PATENT DOCUMENTS

| | | | | |
|---|---|---|---|---|
| 5,300,002 | A * | 4/1994 | Freye | A63B 23/12 482/114 |
| 5,443,435 | A | 8/1995 | Wilkinson | |
| 5,490,825 | A * | 2/1996 | Wilkinson | A45B 3/00 482/109 |
| 5,586,957 | A * | 12/1996 | Wilkinson | A45B 3/00 482/74 |
| 5,606,772 | A | 3/1997 | Ilic | |
| 5,628,713 | A * | 5/1997 | Wilkinson | A45B 3/00 482/51 |
| 5,653,664 | A | 8/1997 | Jennings | |
| 5,778,914 | A | 7/1998 | Trani | |
| 5,788,608 | A | 8/1998 | Wilkinson | |
| 5,871,025 | A | 2/1999 | Richter | |
| 5,873,147 | A | 2/1999 | Hintz | |
| 5,876,312 | A | 3/1999 | McClendon | |
| 6,085,766 | A | 7/2000 | Geary | |
| 6,539,965 | B1 | 4/2003 | White, III | |
| 7,096,992 | B2 | 8/2006 | Rogg et al. | |
| 7,451,775 | B1 * | 11/2008 | Werner | A45B 9/02 135/65 |
| 7,458,160 | B2 | 12/2008 | Escobar et al. | |
| D593,821 | S | 6/2009 | Kopp et al. | |
| 7,557,286 | B2 | 7/2009 | Capotosto | |
| 7,708,671 | B2 | 5/2010 | Burkhardt | |
| 7,712,478 | B2 * | 5/2010 | Gibbons | A61H 3/02 135/66 |
| D638,192 | S | 5/2011 | Hatcher et al. | |
| 7,934,567 | B1 * | 5/2011 | Madey | E04H 17/263 173/132 |
| D644,701 | S | 9/2011 | Towley, III et al. | |
| 8,012,069 | B2 | 9/2011 | Towley, III et al. | |
| 8,500,609 | B1 | 8/2013 | Williams | |
| 8,684,889 | B1 | 4/2014 | Berrisford | |
| 9,277,794 | B2 | 3/2016 | Moreau | |
| 10,086,225 | B2 | 10/2018 | Sheppard et al. | |
| 10,172,427 | B2 | 1/2019 | D'Jay | |
| 2002/0066163 | A1 | 6/2002 | Lomax | |
| 2003/0145881 | A1 | 8/2003 | Harroun | |
| 2004/0107544 | A1 | 6/2004 | Skillas | |
| 2006/0011227 | A1 | 1/2006 | McBirney | |
| 2006/0112521 | A1 | 6/2006 | Moshenrose | |
| 2009/0159106 | A1 | 6/2009 | Schulz | |
| 2010/0051077 | A1 | 3/2010 | McGann | |
| 2013/0104691 | A1 | 5/2013 | Chesner et al. | |
| 2013/0204247 | A1 | 8/2013 | Triplett | |
| 2014/0024506 | A1 | 1/2014 | Vixathep | |
| 2014/0151971 | A1 | 6/2014 | Workman et al. | |
| 2015/0129685 | A1 | 5/2015 | Hall | |
| 2015/0368924 | A1 | 12/2015 | Izradel | |
| 2018/0016764 | A1 | 1/2018 | Hamilton | |
| 2018/0035795 | A1 | 2/2018 | Cloutier | |
| 2019/0069650 | A1 | 3/2019 | Walker | |

FOREIGN PATENT DOCUMENTS

| | | |
|---|---|---|
| CN | 2762608 | 3/2006 |
| CN | 201978394 | 9/2011 |
| CN | 102349730 | 2/2012 |
| CN | 103653594 | 3/2014 |
| CN | 105771163 | 7/2016 |
| CN | 205483508 | 8/2016 |
| CN | 108125341 | 6/2018 |
| CN | 208176863 | 12/2018 |
| CN | 208192392 | 12/2018 |
| CN | 208259229 | 12/2018 |
| DE | 202004013449 | 3/2005 |
| DE | 102004041634 | 3/2006 |
| DE | 202006013876 | 11/2006 |
| DE | 102005028914 | 1/2007 |
| DE | 202007014246 | 2/2008 |
| DE | 102007013726 | 9/2008 |
| DE | 20201105049 | 9/2012 |
| EP | 0585294 | 8/1996 |
| EP | 2712835 | 4/2014 |
| EP | 2944434 | 7/2016 |
| EP | 3205227 | 8/2017 |
| GB | 462136 | 3/1937 |
| GB | 2490168 | 10/2012 |
| JP | 2010005318 | 1/2010 |
| KR | 100403961 | 11/2003 |
| KR | 200387987 | 6/2005 |
| KR | 2020100009866 | 10/2010 |
| KR | 101333601 | 11/2013 |
| TW | 195752 | 12/1992 |
| WO | WO2005089692 | 9/2005 |
| WO | WO2006038860 | 4/2006 |
| WO | WO2007077544 | 7/2007 |
| WO | WO2011048028 | 4/2011 |
| WO | WO2014142671 | 9/2014 |
| WO | WO2017190014 | 11/2017 |
| WO | WO2018141599 | 8/2018 |

OTHER PUBLICATIONS

Final Office Action of U.S. Appl. No. 15/480,680 dated Mar. 14, 2018;10 pps.

Office Action of U.S. Appl. No. 15/720,217 dated May 3, 2018; 6 pps.

Notice of Allowance of U.S. Appl. No. 15/720,217 dated Sep. 13, 2018; 5 pps.

Website: "http://www.gorillastrength.us/shop/landmine/landmine-attachments/set-of-2-righteous-landmine-handles/" Gorilla Strength Equipment; download date: Aug. 29, 2019; 6 pps.

Website: "https://www.dwctrade.top/strength-training-c-3_4/bodysolid-kettleball-25-lb-vinyl-dipped-kettlebell-with-multigrip-angled-handle-p-2793.html" Body-Solid Kettleball; 1 pps.

Website: "https://www.alibaba.com/product-detail/Straight-Handle-Retractable-Aluminum-Alloy-Hiking_60100412321.html" Straight Handle; 1 pps.

* cited by examiner

SYSTEMS AND METHODS FOR ADJUSTABLE LENGTH WEIGHTED TREKKING POLES

CROSS-REFERENCE TO RELATED APPLICATIONS

The present application is a non-provisional of, and claims benefit and priority under 35 U.S.C. § 119(e) to, U.S. Provisional Patent Application No. 62/711,835 filed on Jul. 30, 2018 and titled "SOLID METAL WEIGHTED TREKKING POLES WITH SLIDE-ON ANNULAR WEIGHTS AND REMOVABLE HEAVY, DURABLE RUBBER TIP PROTECTOR WHICH SCREWS ON TO SUPPORT WEIGHTS", the entirety of which is hereby incorporated by reference herein.

BACKGROUND

Various types of hand-held canes, staffs, sticks, and poles are utilized for various purposes. While their usage dates back millennia, modern usages are typical in various sports and activities such as skiing, walking, and hiking (or trekking, running, etc.). As many of these activities are centered on physical fitness, there have been a wide variety of efforts to increase the effectiveness of hand-held poles as workout tools by adding weights thereto.

In U.S. Pat. No. 5,443,435 to Wilkinson, for example, weighted portions are added to either the bottom or handle of an adjustable-length exercise/sport pole to increase arm exercise functionality thereof. Similarly, in British Patent Application No. GB2490168A to Robinson, donut or disk-shaped weights are mounted to the bottom or top of an adjustable-length Nordic walking pole to achieve the same benefit. In U.S. Pat. No. 5,876,312 to McClendon, interior weights (steel balls) are similarly added to top or bottom portions of a multi-segment walking stick, in U.S. Patent Application Publication No. 2003/0145881 to Harroun weights are added to the bottom (interior) of an adjustable height therapeutic cane, and in U.S. Pat. No. 8,500,609 to Williams an attachable weight assembly for a pole is disclosed.

These and other attempts at providing weighted poles, while offering certain advantages, suffer from various deficiencies.

BRIEF DESCRIPTION OF THE DRAWINGS

An understanding of embodiments described herein and many of the attendant advantages thereof may be readily obtained by reference to the following detailed description when considered with the accompanying drawings, wherein.

DETAILED DESCRIPTION

I. Introduction

Figure 1A:
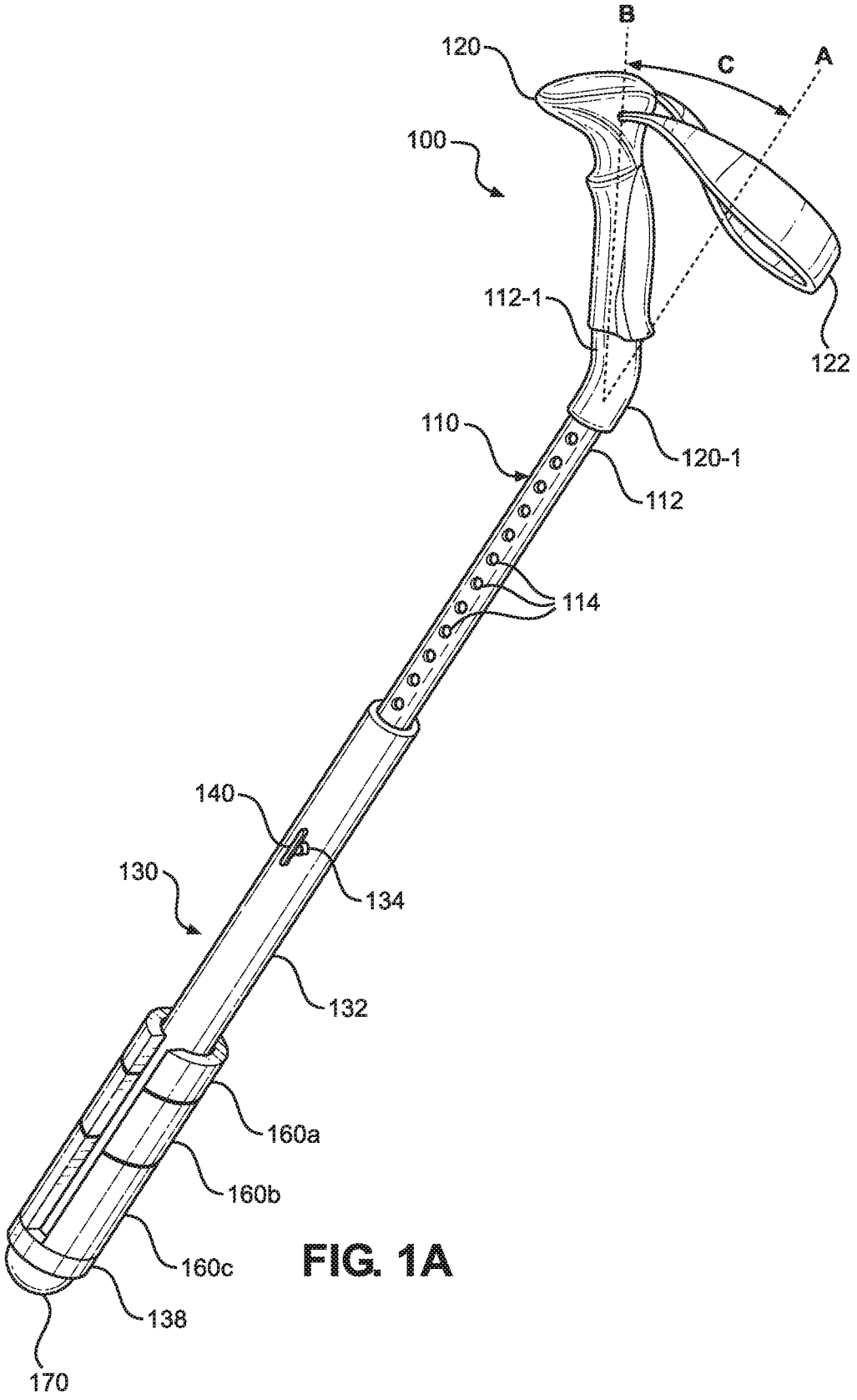
FIG. 1A and FIG. 1B are left-front perspective and front assembly views of an adjustable length, multi-segment, weighted trekking pole system according to some embodiments.

Embodiments presented herein are descriptive of systems, apparatus, methods, and articles of manufacture for multi-segment, adjustable length, weighted trekking poles (and/or portions thereof). In some embodiments, a two-segment or three-segment adjustable length trekking pole may be provided with exterior-mounted weights secured by a locking mechanism. According to some embodiments, the exterior-mounted weights and attendant locking mechanism(s) may be coupled to either or both of a middle segment or a lower segment of a multi-segment trekking pole. According to some embodiments, a trekking pole may be adapted to withstand increased forces due to additional weight loading by including crescent or slotted annular weights, such as by providing for locking adjustability via pin and hole couplings. In such a manner, for example, multi-segment trekking (or other) poles may be quickly and easily adapted to add mid-mounted and/or lower-mounted weights that enhance the workout functionality of the poles. In some embodiments, the weights may comprise liquid bladders, bottles, and/or other storage vessels. In such a manner, for example, the additional weight carried by the pole may be useful, such as for hydration of a hiker, runner, or walker exercising with the weighted pole.

Typical multi-segment, adjustable length trekking poles are designed to be light-weight and offer ground-engaging stability, particularly in trail hiking or off-road uses. They also offer some physical fitness benefits by promoting arm and upper-body movement that, e.g., may be lacking in standard walking or other lower-body engaging exercise activities. Previous attempts at adding weight to enhance the upper-body workout benefits of utilizing such poles have offered some advantages but remain deficient. Most previous attempts, for example, utilize friction or clasp fittings to join the multiple segments of the pole, which may not be sufficient in the case that a pole is loaded with increasing levels of annular weights. Friction or clasp fittings may not, for example, provide adequate longitudinal resistance to prevent a weighted pole segment from de-coupling (e.g., such a pole may come apart under the strain of weight loading).

Embodiments for adjustable length, multi-segment weighted trekking poles presented herein solve these and other deficiencies of previous weighted pole designs. Embodiments herein provide for mid-weighted or lower-weighted poles, for example, that are capable of being weighted utilizing slide-on crescent or slotted annular weights. According to some embodiments, coupling of the multiple segments of the poles may be accomplished by utilizing a lateral (or latitudinal) pin and hole mechanism operable to bear longitudinal weight in excess of the weight of the exterior-mounted crescent or slotted annular weights. In such a manner, for example, a pole for weighted exercise may be provided that is simple to manufacture, easy to use, capable of disassembly for storage and/or transport, and is rugged enough to support substantial added exterior weights. These and other attendant advantages are readily perceived in light of the detailed description of the embodiments presented herein.

II. Adjustable Length, Multi-Segment, Weighted Trekking Pole Systems

Figure 1B:
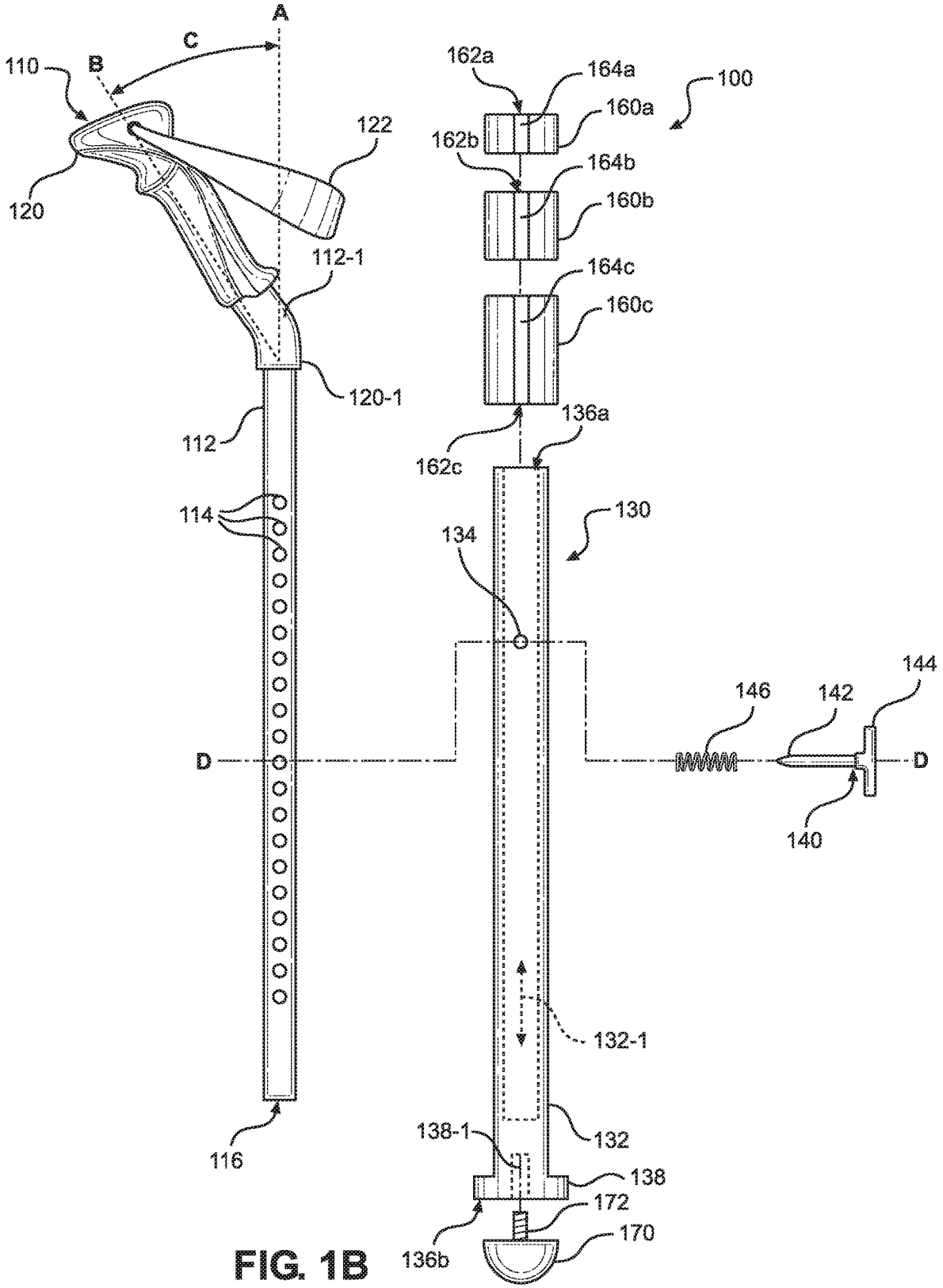

Referring initially to FIG. 1A and FIG. 1B, left-front perspective and front assembly views of an adjustable length, multi-segment, weighted trekking pole system 100 according to some embodiments are shown. In some embodiments, the trekking pole 100 may comprise a first, upper, or handle segment 110. The handle segment 110 may comprise, for example a first or upper shaft 112 such as a carbon-fiber, aluminum, or steel tube or shaft and/or may be approximately thirty-four inches (34") or eighty-six and thirty-six hundredths centimeters (86.36 cm) in length. In some embodiments, the upper shaft 112 may comprise an upper angled portion 112-1. The upper shaft 112 may, for example, comprise a cylindrical, oval, or rectilinear cross-section rod oriented along an axis "A" with the upper angled portion 112-1 being oriented along a second axis "B". According to some embodiments, an angle "C" may be formed between the "A" axis and the "B" axis (e.g., in a particular geometric plane; not separately labeled). In some embodiments, the angle "C" may comprise an angle between ten degrees (10°) and fifty-five degrees (55°). According to some embodiments, the angle "C" may be configured between fifteen degrees (15°) and twenty-five degrees (25°) for enhanced ergonomics while in some embodiments the angle "C" may be configured between forty-five degrees (45°) and fifty-five degrees (55°) to enhance ease of height adjustability of the adjustable length, multi-segment, weighted trekking pole system 100. According to some embodiments, the angle "C" may be adjustable such as by providing a pivot pin (not shown) and/or other adjustment mechanism, e.g., at the junction of the upper shaft 112 and the upper angled portion 112-1. In such a manner, for example, the angle "C" may be user-selectable and/or defined. In some embodiments, the upper shaft 112 may comprise a plurality of upper coupling holes 114 extending laterally or radially through the upper shaft 112 and/or handle segment 110. In some embodiments, as depicted in FIG. 1A, the upper coupling holes 114 may extend through the upper shaft 112 along and/or parallel to the plane formed by the "A" axis and the "B" axis. According to some embodiments, as depicted in FIG. 1B, the upper coupling holes 114 may extend through the upper shaft 112 perpendicular to the plane formed by the "A" axis and the "B" axis. In some embodiments, twenty-four (24) upper coupling holes 114 may be provided, e.g., spaced approximately one inch (1") or two and fifty-four hundredths centimeters (2.54 cm) apart.

According to some embodiments, the upper shaft 112 and/or the handle segment 110 may define and/or comprise a first or bottom end 116 (e.g., a "male" end; opposite the upper angled portion 112-1). In some embodiments, the upper shaft 112 and/or the handle segment 110 may comprise, at a second or top end thereof (e.g., at or on the upper angled portion 112-1), a handle 120 (e.g., having a neck portion 120-1) and/or a wrist strap 122. The handle 120 may comprise, for example, a molded, formed, and/or shaped element made of various desirable handle materials such as rubber, wood (e.g., cork), foam, etc. According to some embodiments, the handle 120 may be selectively coupled and removed from the upper shaft 112, e.g., via a threaded coupling (or other style coupling; not explicitly shown) between the neck 120-1 and the upper shaft 112. According to some embodiments, the length or height of the handle portion 110 may, in the case of a removable handle 120, by approximately thirty-seven inches (37") or ninety-three and ninety-eight hundredths centimeters (93.98 cm). In some embodiments, the handle 120 may comprise the upper angled portion 112-1. In the case that the handle 120 is detachable and/or interchangeable with other handle designs (not shown in FIG. 1A or FIG. 1B; e.g., the handle 220 of FIG. 2A and/or FIG. 2B herein), for example, removal of the handle 120 and respective neck 120-1 may remove the upper angled portion 112-1 from the upper shaft 112, such that a straight-shaft portion and/or handle may be substituted for the upper angled portion 112-1. The wrist strap 122 may comprise a strip of rubber, fabric, cloth, and/or a lanyard coupled to the handle 120 and/or forming a loop via which, e.g., a user (not shown) may engage their wrist while holding the handle 120. As depicted in FIG. 1A and FIG. 1B, the handle 120 may be coupled to the upper angled portion 112-1 such that the handle 120 is likewise oriented along the "B" axis, forming the angle "C" with the "A" axis. In such a manner, for example, the handle 120 may be better ergonomically positioned for some users when utilizing the weighted trekking pole system 100 as a weight-lifting exercise tool.

According to some embodiments, the adjustable length, multi-segment, weighted trekking pole system 100 may comprise a lower segment 130. In some embodiments, the lower segment 130 may comprise a lower shaft 132 that defines an interior passage 132-1 extending lengthwise or axially within the lower shaft 132. In some embodiments, the lower shaft 132 may be constructed of aluminum, steel, or carbon-fiber and/or may be approximately twenty-five inches (25") or sixty-three and five tenths centimeters (63.5 cm) in length. In some embodiments, the lower shaft 132 may comprise a lower coupling hole 134 extending laterally or radially through the lower shaft 132 and/or lower segment 130. According to some embodiments, a first or top end of the lower shaft 132 may define and/or comprise a first or upper opening 136*a* into the interior passage 132-1 (e.g., a "female" end or opening). In some embodiments, a second or bottom end 136*b* of the lower shaft 132 may define and/or comprise an exterior flange 138 and/or a threaded hole 138-1. According to some embodiments, the interior passage 132-1 of the lower shaft 132 may accept and/or couple to the upper shaft 112. The first or bottom end 116 of the upper shaft 112 may be inserted into the interior passage 132-1 such that one or more of the upper coupling holes 114 align with the lower coupling hole 134. In some embodiments, a mounting pin 140 may be inserted through the respective coupling holes 114, 134, e.g., along a third axis "D", perpendicular to the first axis "A". The mounting pin 140 may comprise, for example, a pin body 142 extending along the "D" axis and a handle portion 144 coupled at one end (e.g., to provide a perpendicular gripping surface and/or to limit passage of the mounting pin 140 into the coupling holes 114, 134). According to some embodiments, the mounting pin 140 may comprise and/or be coupled to a spring 146. The spring 146 may be disposed on the mounting pin 140 and/or along the "D" axis, for example, or may be otherwise coupled to provide elastic engagement of the mounting pin 140 with the coupling holes 114, 134. According to some embodiments, the spring 146 may act parallel to the "A" axis, such as to selectively bias an element such as a ball (not shown) along the pin body 142 such that the pin shaft 142 cannot freely pass through the coupling holes 114, 134. In such a manner, for example, the mounting pin 140 may only be engaged or disengaged with the coupling holes 114, 134 by application of sufficient lateral or radial fore thereupon (e.g., it may be prevented from accidental disengagement). According to some embodiments, the mounting pin 140 may be fixed to the lower shaft 132 and may be selectively movable between multiple positions along the "D" axis to either engage or disengage with the upper shaft 112.

In some embodiments, the lower segment 130 may comprise a plurality of weights 160*a-c*. The weights 160*a-c* may, for example, comprise annular elements that slide onto the lower shaft 132. According to some embodiments, the weights 160*a-c* may comprise slotted cylindrical, annular, and/or crescent-shaped metal elements having internal bores 162*a-c* through which the outside diameter of the lower shaft 132 may freely pass. According to some embodiments, the weights 160*a-c* may be constructed of cast iron and/or may be covered or coated with one or more protective layers such as a rubberized coating, a neoprene sleeve, etc. The weights 160*a-c* may comprise equal diameters but differing thicknesses, such that each weight 160*a-c*, in some embodiments, weighs one of: (i) one pound (1 lb) or forty-five hundredths of a kilogram (0.45 kg), (ii) two pounds (2 lb) or ninety-one hundredths of a kilogram (0.91 kg), or (iii) five pounds (5 lb) or two and twenty-seven hundredths kilograms (2.27 kg). In the non-limiting example case of the three (3) weights 160*a-c* being utilized as depicted in FIG. 1A and FIG. 1B, approximately eight pounds (8 lb) or three and sixty-three hundredths kilograms (3.63 kg) of weight/mass may be retained by the exterior flange 138 of the lower shaft 132 (e.g., a first weight 160*a* may weigh one pound (1 lb) or forty-five hundredths of a kilogram (0.45 kg), a second weight 160*b* may weigh two pounds (2 lb) or ninety-one hundredths of a kilogram (0.91 kg), and/or a third weight 160*c* may weigh five pounds (5 lb) or two and twenty-seven hundredths kilograms (2.27 kg)). According to some embodiments, the weights 160*a-c* may total thirty-five pounds (35 lb) or fifteen and eighty-eight hundredths kilograms (15.88 kg) such as by including each of a five pound (5 lb) or two and twenty-seven hundredths kilograms (2.27 kg), a ten pound (10 lb) or four and fifty-four hundredths kilograms (4.54 kg), and a twenty pound (20 lb) or nine and seven hundredths kilograms (9.07 kg) weight 160*a-c*.

In some embodiments, the weights 160*a-c* may comprise slots 164*a-c* extending from the internal bores 162*a-c* to the exterior surfaces thereof. In such a manner, for example, the weights 160*a-c* may be described as crescent or "C"-shaped or may be referred to as a collar or sleeve. In some embodiments, the slots 164*a-c* may allow the weights 160*a-c* to be added to or removed from the lower shaft 132 while the mounting pin 140 is in place. In the case that the mounting pin 140 is mounted to and/or not readily removable from the lower shaft 132, for example, the slots 164*a-c* may permit the weights 160*a-c* to be slipped onto the lower shaft 132 by orienting the slots 164*a-c* with the protruding mounting pin 140. Once the mounting pin 140 is passed through each respective slot 164*a-c*, for example, the weights 160*a-c* may be slid down to rest on the exterior flange 138 of the lower shaft 132. In some embodiments, the exterior flange may be at least on half of an inch (0.5") or one and twenty-six hundredths centimeters (1.26 cm) thick, e.g., to support the weights 160*a-c*. According to some embodiments, one or more of the weights 160*a-c* may comprise hollow annular slotted cylinders defining internal volumes (not depicted) filled with various desirable weight-bearing substances. The weights 160*a-c* may be filled with sand, concrete, rocks, and/or other solid or granular substances, for example, and/or may be filled with water, glycol, and/or other liquids. The weights 160*a-c* may, for example, comprise one or more "C"-shaped water bottles having the internal bores 162*a-c* and slots 164*a-c*. According to some embodiments, the weights 160*a-c* may comprise a valve, nipple, spout, and/or other feature (not shown) that permits substances disposed within any interior void to be added or removed therefrom, as desired.

In some embodiments, the adjustable length, multi-segment, weighted trekking pole system 100 may comprise a foot 170. The foot 170 may comprise, for example an engaging element such as a ground-engaging rubber or plastic tip. In some embodiments, the foot 170 may comprise multiple inches of dense rubber with a steel or metal core, e.g., of at least two inches (2") or five and eight hundredths centimeters (5.08 cm) in axial thickness. According to some embodiments, the foot 170 may comprise a threaded post 172 disposed to engage with the threaded hole 138-1 of the lower shaft 132. Internal threads of the threaded hole 138-1 may be disposed, for example, to be operable to be engaged with exterior threads of the threaded post 172 to removably couple the foot 170 to the lower shaft 132.

According to some embodiments, the assembly of the adjustable length, multi-segment, weighted trekking pole system 100 may be as depicted in FIG. 1B. The first or male end 116 of the upper shaft 112 may define and/or comprise an outside diameter that is smaller than an inside diameter of the interior passage 132-1 of the lower shaft 132, for example, and may be inserted into and/or nested therein (e.g., by at least three inches (3") or seven and sixty-two hundredths centimeters (7.62 cm) of "male" insertion distance, such as to permit an adequately strong coupling and/or to reduce the strain placed on the upper shaft 112). The first or male end 116 may be inserted into the upper opening 136*a* of the lower shaft 132, in some embodiments, and selectively secured in place at a desired level of insertion by engagement and/or activation of the mounting pin 140 with an aligned pair of coupling holes 114, 134. In some embodiments, the upper coupling holes 114 may be labeled or numbered such that a user may selectively adjust the overall length of the weighted trekking pole system 100 in a repeatable manner. According to some embodiments, the first or male end 116 of the upper shaft 112 and/or the edges of the upper opening 136*a* of the lower shaft 132 may comprise and/or be coupled to an end protector (not shown) such as a plastic or rubber tip, lip, or covering, e.g., to reduce and/or prevent damage (e.g., chipping) from abutment or collision of the first or male end 116 of the upper shaft 112 with the upper opening 136*a* of the lower shaft 132 (e.g., within the interior passage 132-1).

In some embodiments, any desired quantity and/or mass or size of weights 160*a-c* and/or may be inserted onto the lower shaft 132, e.g., from the first end 136*a* thereof. In such a manner, for example, the adjustable length, multi-segment, weighted trekking pole system 100 may be outfitted with a variable amount of weight (e.g., the weights 160*a-c*) between the handle segment 110 and the lower segment 130, permitting not only enhanced fitness capabilities that are less likely to result in injury (e.g., wrist straining and/or loss of balance; such as due in part from the angle "C" of the handle 120) but also providing for quick and easy change-over to different weight levels and/or to a standard trekking pole configuration, as desired.

The adjustable length, multi-segment, weighted trekking pole system 100 is described as a "trekking pole" for purposes of illustration and ease of description. While in some embodiments the adjustable length, multi-segment, weighted trekking pole system 100 may be constructed and/or utilized for hiking, trekking, walking, and/or "Nordic-style" walking (and/or running), the adjustable length, multi-segment, weighted trekking pole system 100 may also or alternatively be constructed and/or utilized for skiing, exercising, and/or other activities that are or become practicable. While one style of handle 120 is depicted, other styles of handle 120 (such as those depicted and/or described herein) may be utilized in the adjustable length, multi-segment, weighted trekking pole system 100 without deviating from some embodiments. While one style of mounting pin 140 is depicted and described, different types, quantities, and/or styles of mounting pins 140 may be utilized in some embodiments, as is or becomes known or practicable. According to some embodiments, the mounting pin 140 may extend entirely through the diameters of the lower shaft 132 and the upper shaft 112 and protrude therefrom such that a cotter pin, clip, clamp, and/or other retaining feature (not shown) may be selectively engaged to retain the exposed end of the pin body 142 exterior to the outside diameter of the lower shaft 132 (e.g., prevent disengagement of the mounting pin 140 with the lower shaft 132).

In some embodiments, any or all of the components 110, 112, 112-1, 114, 116, 120, 120-1, 122, 130, 130-1, 132, 134, 136*a-b*, 138, 138-1, 140, 142, 144, 146, 160*a-c*, 162*a-c*, 164*a-c*, 170, 172 of the adjustable length, multi-segment, weighted trekking pole system 100 may be similar in configuration and/or functionality to any similarly named and/or numbered components described herein. Fewer or more components 110, 112, 112-1, 114, 116, 120, 120-1, 122, 130, 130-1, 132, 134, 136*a-b*, 138, 138-1, 140, 142, 144, 146, 160*a-c*, 162*a-c*, 164*a-c*, 170, 172 (and/or portions thereof) and/or various configurations of the components 110, 112, 112-1, 114, 116, 120, 120-1, 122, 130, 130-1, 132, 134, 136*a-b*, 138, 138-1, 140, 142, 144, 146, 160*a-c*, 162*a-c*, 164*a-c*, 170, 172 may be included in the adjustable length, multi-segment, weighted trekking pole system 100 without deviating from the scope of embodiments described herein. In some embodiments, one or more of the various components 110, 112, 112-1, 114, 116, 120, 120-1, 122, 130, 130-1, 132, 134, 136*a-b*, 138, 138-1, 140, 142, 144, 146, 160*a-c*, 162*a-c*, 164*a-c*, 170, 172 may not be needed and/or desired in the adjustable length, multi-segment, weighted trekking pole system 100.

Figure 2A:
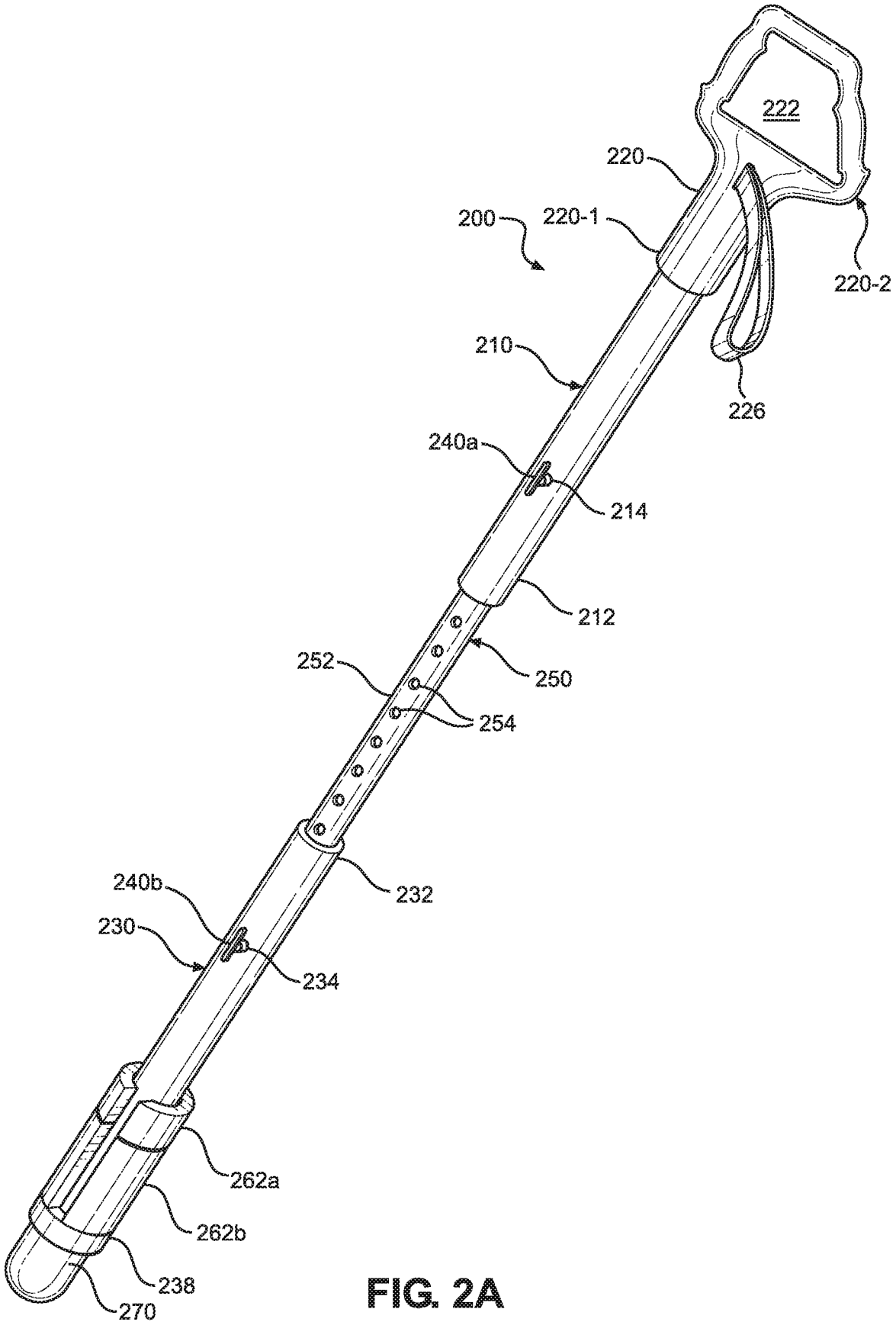
FIG. 2A and FIG. 2B are left-front perspective and front assembly views of an adjustable length, multi-segment, weighted trekking pole system according to some embodiments.
Figure 2B:
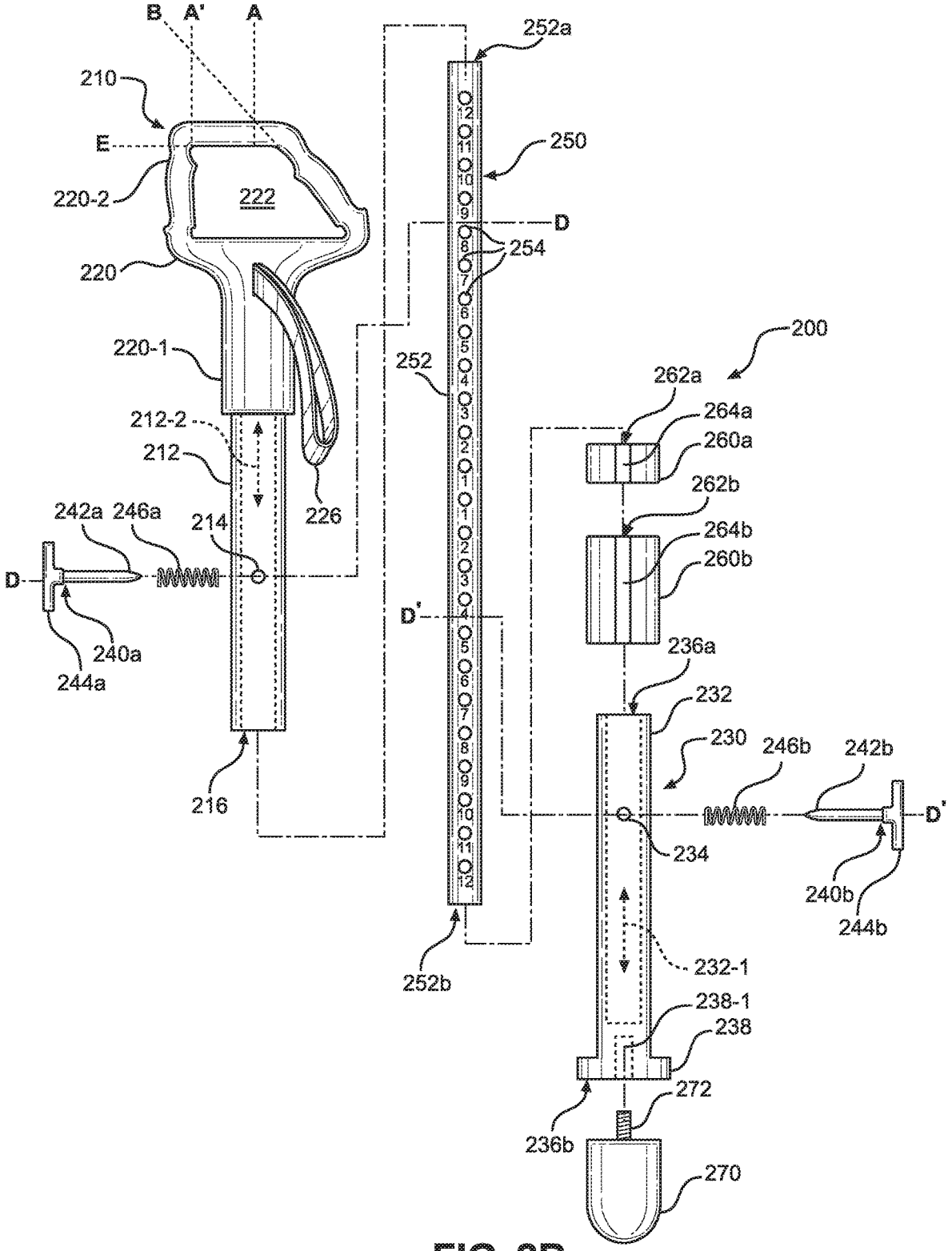

Turning to FIG. 2A and FIG. 2B, left-front perspective and front assembly views of an adjustable length, multi-segment, weighted trekking pole system 200 according to some embodiments are shown. In some embodiments, the trekking pole 200 may comprise a first, upper, or handle segment 210. The handle segment 210 may comprise, for example a first or upper shaft 212 such as a hollow carbon-fiber, steel, or aluminum tube and/or may be approximately twenty-two (22") or fifty-five and eighty-eight hundredths centimeters (55.88 cm) in length. The upper shaft 212 may, for example, define an upper interior passage 212-2 extending axially along or parallel to a first axis "A" and/or within the upper shaft 212 and/or handle segment 210. In some embodiments, the upper shaft 212 may comprise an upper coupling hole 214 extending laterally or radially through the upper shaft 212 and/or handle segment 210. In some embodiments, as depicted in FIG. 2A, the upper coupling hole 214 may extend through the upper shaft 212 perpendicular to the plane formed by a first axis "A" axis and a second parallel axis "A'". According to some embodiments (not depicted), the upper coupling hole 214 may extend through the upper shaft 212 along and/or parallel to the plane formed by the "A" axis and the "A'" axis.

According to some embodiments, a first or bottom end of the upper shaft 212 and/or the handle segment 210 may define and/or comprise a first or upper opening 216 (e.g., a first "female" opening) into the upper interior passage 212-2. According to some embodiments, the upper shaft 212 and/or the handle segment 210 may comprise, at a second or top end thereof, a handle 220. The handle 220 may comprise, for example, a molded, formed, and/or shaped element made of various desirable handle materials such as rubber, wood (e.g., cork), foam, etc. In some embodiments, the handle 220 may comprise a neck portion 220-1 coupled to the second or upper end of the upper shaft 212 and multi-use grip portion 220-2. According to some embodiments, the multi-use grip portion 220-2 may be formed to define an interior grip area 222. The grip area 222 may, for example, be formed to define various interior surfaces (not separately labeled in FIG. 2A or FIG. 2B) aligned with the first axis "A", the second axis "A'", a third axis "B" formed at an angle with the first axis "A" and/or the second axis "A'", and/or a fourth axis "E" formed perpendicular to the first axis "A" and/or the second axis "A'". According to some embodiments, a strap 226 may be coupled to the handle 220 and/or the neck 220-1 thereof. According to some embodiments, the strap 226 may comprise a strip of rubber, fabric, cloth, and/or an adjustable lanyard coupled to the handle 220 and/or forming a loop via which, e.g., a user (not shown) may engage their wrist while holding the handle 220.

In some embodiments, the adjustable length, multi-segment, weighted trekking pole system 200 may comprise a lower segment 230. In some embodiments, the lower segment 230 may comprise a lower shaft 232 that defines an interior passage 232-1 extending lengthwise or axially within the lower shaft 232. In some embodiments, the lower shaft 232 may be constructed of aluminum, steel, or carbon-fiber and/or may be approximately eighteen inches (18") or forty-five and seventy-two hundredths centimeters (45.72 cm) in length. In some embodiments, the lower shaft 232 may comprise a lower coupling hole 234 extending laterally or radially through the lower shaft 232 and/or lower segment 230. According to some embodiments, a first or top end of the lower shaft 232 may define and/or comprise a second or lower opening 236*a* into the interior passage 232-1 (e.g., a second "female" end or opening). In some embodiments, a second or bottom end 236*b* of the lower shaft 232 may define and/or comprise an exterior flange 238 and/or a threaded hole 238-1. In some embodiments, one or more mounting pins 240*a-b* (e.g., comprising a pin body 242*a-b*, a handle portion 244*a-b*, and/or a spring 246*a-b*) may be utilized to couple two or more of the handle segment 210, the lower segment 230, and a middle segment 250.

The adjustable length, multi-segment, weighted trekking pole system 200 may comprise a middle segment 250, for example, comprising a middle shaft 252. In some embodiments, the middle shaft 252 may be constructed of aluminum, steel, or carbon-fiber and/or may be fifteen inches (15") or thirty-eight and one tenth centimeters (38.1 cm) in length or shorter (e.g., to enhance portability) or longer (e.g., to increase the range of adjustability). According to some embodiments, a first or top end of the middle shaft 252 may define and/or comprise a first or upper-middle end 252*a* (e.g., a first "male" end). In some embodiments, a second or bottom end of the middle shaft 252 may define and/or comprise a second or lower-middle end 252*b* (e.g., a second "male" end). According to some embodiments, the middle shaft 252 may comprise a plurality of middle coupling holes 254 extending laterally or radially through the middle shaft 252 and/or middle segment 250. In some embodiments, the middle coupling holes 254 may be evenly spaced along the length of the middle shaft 252 and/or may be labeled or numbered such that a user may readily identify or reproduce a desired level of adjustment of the weighted trekking pole system 200. As shown in FIG. 2B, for example, twenty-four (24) middle coupling holes 254 may be provided, e.g., spaced approximately one inch (1") or two and fifty-four hundredths centimeters (2.54 cm) apart, e.g., providing for a length of the middle segment 250 of approximately twenty-six inches (26") or sixty-six and four hundredths centimeters (66.04).

In some embodiments, the mounting pins 240*a-b* may couple (i) the handle segment 210 and the middle segment 250 and/or (ii) the middle segment 250 and the lower segment 230. A first mounting pin 240*a* may be inserted, for example, through respective upper and middle coupling holes 214, 254, e.g. along an axis "D", perpendicular to the first axis "A". In some embodiments, a second mounting pin 240*b* may be inserted through respective lower and middle coupling holes 234, 254 e.g., along an axis "D'", perpendicular to the first axis "A". The mounting pins 240*a-b* may comprise, for example, the pin body 242*a-b* extending along the respective "D" or "D'" axis and the handle portion 244 coupled at one end (e.g., to provide a perpendicular gripping surface and/or to limit passage of the mounting pins 240*a-b* into the coupling holes 214, 234, 254). According to some embodiments, the mounting pins 240*a-b* may comprise and/or be coupled to the spring 246*a-b*. The spring 246*a-b* may be disposed on the respective mounting pin 240*a-b* and/or along the respective "D" or "D'" axis, for example, or may be otherwise coupled to provide elastic engagement of the mounting pins 240*a-b* with the coupling holes 214, 234, 254. According to some embodiments, the spring 246*a-b* may act parallel to the "A" axis, such as to selectively bias an element such as a ball (not shown) along the pin body 242*a-b* such that the pin shaft 242*a-b* cannot freely pass through the coupling holes 214, 234, 254. In such a manner, for example, the mounting pins 240*a-b* may only be engaged or disengaged with the coupling holes 214, 234, 254 by application of sufficient lateral or radial force thereupon (e.g., may be prevented from accidental disengagement). According to some embodiments, the mounting pins 240*a-b* may be fixed to the respective lower shaft 232 or the upper shaft 212 and may be selectively movable between multiple positions along the "D" or "D'" axis to either engage or disengage with the middle shaft 252. As depicted, in some embodiments the first mounting pin 240*a* may be utilized to couple the handle segment 210 to the middle segment 250 and the second mounting pin 240*b* may be utilized to couple the lower segment 230 to the middle segment 250. In such a manner, for example, the adjustable length, multi-segment, weighted trekking pole system 200 may be readily broken down into three (3) separate pieces or lengths, e.g., for easy packing, storage, and/or transport. Utilizing the three (3) segments 210, 230, 250 and attendant coupling holes 214, 234, 254 may also or alternatively provide for increased options for selecting adjustable lengths or configurations of the adjustable length, multi-segment, weighted trekking pole system 200.

In some embodiments, the lower segment 230 may comprise a plurality of weights 260*a-b*. The weights 260*a-b* may, for example, comprise annular elements that slide onto the lower shaft 232. According to some embodiments, the weights 260*a-b* may comprise slotted cylindrical, annular, and/or crescent-shaped metal elements having internal bores 262*a-b* through which the outside diameter of the lower shaft 232 may freely pass. According to some embodiments, the weights 260*a-b* may be constructed of cast iron and/or may be covered or coated with one or more protective layers such as a rubberized coating, a neoprene sleeve, etc. The weights 260*a-b* may comprise equal diameters but differing thicknesses, such that each weight 260*a-b*, in some embodiments, weighs one of: (i) one pound (1 lb) or forty-five hundredths of a kilogram (0.45 kg), (ii) two pounds (2 lb) or ninety-one hundredths of a kilogram (0.91 kg), or (iii) five pounds (5 lb) or two and twenty-seven hundredths kilograms (2.27 kg). In the non-limiting example case of the two (2) weights 260*a-b* being utilized as depicted in FIG. 2A and FIG. 2B, approximately seven pounds (7 lb) or three and eighteen hundredths kilograms (3.18 kg) of weight/mass may be retained by the exterior flange 238 of the lower shaft 232 (e.g., a first weight 260*a* may weigh two pounds (2 lb) or ninety-one hundredths of a kilogram (0.91 kg) and/or a second weight 260*b* may weigh five pounds (5 lb) or two and twenty-seven hundredths kilograms (2.27 kg)).

In some embodiments, the weights 260*a-b* may comprise slots 264*a-b* extending from the internal bores 262*a-b* to the exterior surfaces thereof. In such a manner, for example, the weights 260*a-b* may be described as crescent or "C"-shaped. In some embodiments, the slots 264*a-b* may allow the weights 260*a-b* to be added to or removed from the lower shaft 232 while the mounting pin 240 (or second mounting pin 240*b*) is in place. In the case that the second mounting pin 240*b* is mounted to and/or not readily removable from the lower shaft 232, for example, the slots 264*a-b* may permit the weights 260*a-b* to be slipped onto the lower shaft 232 by orienting the slots 264*a-b* with the protruding second mounting pin 240*b*. Once the second mounting pin 240*b* is passed through each respective slot 264*a-b*, for example, the weights 260*a-b* may be slid down to rest on the exterior flange 238 of the lower shaft 232. According to some embodiments, one or more of the weights 260*a-b* may comprise hollow annular slotted cylinders defining internal volumes (not depicted) filled with various desirable weight-bearing substances. The weights 260*a-b* may be filled with sand, concrete, rocks, and/or other solid or granular substances, for example, and/or may be filled with water, glycol, and/or other liquids. The weights 260*a-b* may, for example, comprise one or more "C"-shaped water bottles having the internal bores 262*a-b* and slots 264*a-b*. According to some embodiments, the weights 260*a-b* may comprise a valve, nipple, spout, and/or other feature (not shown) that permits substances disposed within any interior void to be added or removed therefrom, as desired.

In some embodiments, the adjustable length, multi-segment, weighted trekking pole system 200 may comprise a foot 270. The foot 270 may comprise, for example an engaging element such as a ground-engaging rubber or plastic tip that is concave, convex, pointed, and/or another configuration that is or becomes known or practicable. According to some embodiments, the foot 270 may comprise a threaded post 272 disposed to engage with the threaded hole 238-1 of the lower shaft 232. Internal threads of the threaded hole 238-1 may be disposed, for example, to be operable to be engaged with exterior threads of the threaded post 272 to removably couple the foot 270 to the lower shaft 232. In some embodiments the foot 270 may extend longitudinally by five inches (5") or twelve and seven tenths centimeters (12.7 cm). The foot 270 may comprise, for example, a metal core of approximately two inches (2") or five and eight hundredths centimeters (5.08 cm) in length covered and/or extended by a durable rubber tip of approximately three inches (3") or seven and sixty-two hundredths centimeters (7.62 cm).

According to some embodiments, the assembly of the adjustable length, multi-segment, weighted trekking pole system 200 may be as depicted in FIG. 2B. The upper-middle or first male end 252*a* of the middle shaft 252 may define and/or comprise an outside diameter that is smaller than an inside diameter of the upper interior passage of the upper shaft 212, for example, and may be inserted into and/or nested therein (e.g., by at least three inches (3") or seven and sixty-two hundredths centimeters (7.62 cm) of "male" insertion distance, such as to permit an adequately strong coupling and/or to reduce the strain placed on the upper shaft 212), e.g., via the upper opening 216. The upper-middle or first male end 252*a* may be inserted into the upper opening 216 of the upper shaft 212, in some embodiments, and selectively secured in place at a desired level of insertion by alignment of two corresponding coupling holes 214, 254 and engagement and/or activation of the first or upper mounting pin 240*a*. Similarly, the lower-middle or second male end 252*b* of the middle shaft 252 may define and/or comprise an outside diameter that is smaller than the inside diameter of the lower interior passage 232-1 of the lower shaft 232 and may be inserted into and/or nested therein. The second male end 252*b* may be inserted into the lower opening 236*a* of the lower shaft 232, for example, and selectively secured in place at a desired level of insertion (e.g., by at least three inches (3") or seven and sixty-two hundredths centimeters (7.62 cm), such as to permit an adequately strong coupling and/or to reduce the strain placed on the lower shaft 232) by alignment of two corresponding coupling holes 234, 254 and engagement and/or activation of the second or lower mounting pin 240*b*. According to some embodiments, the upper or lower male ends 252*a-b* and/or the openings 216, 236*a* may comprise and/or be coupled to an end protector (not shown) such as a plastic or rubber tip, e.g., to reduce and/or prevent damage (e.g., chipping) from abutment or collision of the male ends 252*a-b* with the openings 216, 236*b* (e.g., at the edge of and/or within the interior passages 212-2, 232-1).

In some embodiments, any desired quantity and/or mass or size of weights 260*a-b* may be inserted onto the lower shaft 232, e.g., from the first end 236*a* thereof. In such a manner, for example, the adjustable length, multi-segment, weighted trekking pole system 200 may be outfitted with a variable amount of weight (e.g., the weights 260*a-b*) between the handle segment 210 and the lower segment 230, permitting not only enhanced fitness capabilities that are less likely to result in injury (e.g., wrist straining and/or loss of balance) but also providing for quick and easy change-over to different weight levels and/or to a standard trekking pole configuration, as desired.

The adjustable length, multi-segment, weighted trekking pole system 200 is described as a "trekking pole" for purposes of illustration and ease of description. While in some embodiments the adjustable length, multi-segment, weighted trekking pole system 200 may be constructed and/or utilized for hiking, trekking, walking, and/or "Nordic-style" walking (and/or running), the adjustable length, multi-segment, weighted trekking pole system 200 may also or alternatively be constructed and/or utilized for skiing, exercising, and/or other activities that are or become practicable. While one style of mounting pin 240*a-b* is depicted and described, different types, quantities, and/or styles of mounting pins 240*a-b* may be utilized in some embodiments, as is or becomes known or practicable. According to some embodiments, the mounting pin 240*a-b* may extend entirely through the diameters of the lower shaft 232, the upper shaft 212, and/or the middle shaft 252 and protrude therefrom such that a cotter pin, clip, clamp, and/or other retaining feature (not shown) may be selectively engaged to retain the exposed end of the pin body 242 exterior to the outside diameter of the lower shaft 232 and/or the upper shaft 212 (e.g., prevent disengagement of the mounting pin 240*a-b* with the lower shaft 232 and/or the upper shaft 212).

In some embodiments, any or all of the components 210, 212, 212-2, 214, 216, 220, 220-1, 220-2, 222, 230, 232, 232-1, 234, 236*a-b*, 238, 238-1, 240*a-b*, 242, 244, 246, 260*a-b*, 262*a-b*, 264*a-b*, 270, 272, 272 of the adjustable length, multi-segment, weighted trekking pole system 200 may be similar in configuration and/or functionality to any similarly named and/or numbered components described herein. Fewer or more components 210, 212, 212-2, 214, 216, 220, 220-1, 220-2, 222, 230, 232, 232-1, 234, 236*a-b*, 238, 238-1, 240*a-b*, 242, 244, 246, 260*a-b*, 262*a-b*, 264*a-b*, 270, 272, 272 (and/or portions thereof) and/or various configurations of the components 210, 212, 212-2, 214, 216, 220, 220-1, 220-2, 222, 230, 232, 232-1, 234, 236*a-b*, 238, 238-1, 240*a-b*, 242, 244, 246, 260*a-b*, 262*a-b*, 264*a-b*, 270, 272, 272 may be included in the adjustable length, multi-segment, weighted trekking pole system 200 without deviating from the scope of embodiments described herein. In some embodiments, one or more of the various components 210, 212, 212-2, 214, 216, 220, 220-1, 220-2, 222, 230, 232, 232-1, 234, 236*a-b*, 238, 238-1, 240*a-b*, 242, 244, 246, 260*a-b*, 262*a-b*, 264*a-b*, 270, 272, 272 may not be needed and/or desired in the adjustable length, multi-segment, weighted trekking pole system 200.

III. Multi-Use Handle

Figure 3:
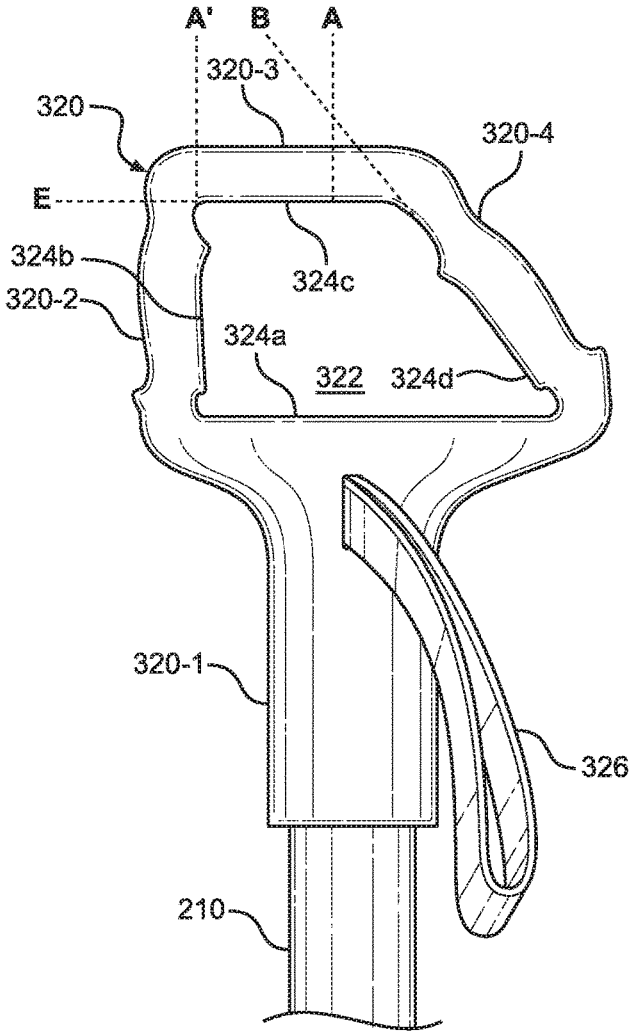
FIG. 3 is a front view of a multi-use handle according to some embodiments.

Referring now to FIG. 3, a front view of a multi-use handle 320 according to some embodiments is shown. According to some embodiments, the multi-use handle 320 may comprise a base or neck portion 320-1 extending parallel to and/or along a first axis "A". The neck portion 320-1 may, for example, couple to a shaft or pole (not shown) such as the handle segment or portion of a trekking, walking, or weighted exercise pole. In some embodiments, the multi-use handle 320 may comprise a first or vertical portion 320-2, a second or horizontal portion 320-3, and/or a third or angled portion 320-4. The configuration of the various portions 320-2, 320-3, 320-4 may, in some embodiments, define or form an interior grip area 322. The interior grip area 322 may, for example, comprise a loop or other enclosed shape via which a user (not shown) may engage with the multi-use handle 320 (e.g., to lift one or more weights; not shown). According to some embodiments, the interior grip area 322 and/or the corresponding portions 320-2, 320-3, 320-4 may define or form various grip surfaces 324*a-d*.

In some embodiments, a first grip surface 324*a* may be formed at a bottom portion of the interior grip area 322. According to some embodiments, the first grip surface 324*a* may comprise a horizontal surface or a surface oriented perpendicular to the first axis "A". The first grip surface 324*a* may, for example, be utilized by a user to bear weight downward upon the multi-use handle 320 (and accordingly any coupled pole) such as to utilize the coupled pole or other device as a rest or crutch.

In some embodiments, a second grip surface 324*b* may be formed between or by the first portion 320-2 and the interior grip area 322. According to some embodiments, the second grip surface 324*b* may comprise a vertical surface or a surface oriented along or parallel to a second axis "A'". The second grip surface 324*b* may be parallel to but offset horizontally or planarly from the first axis "A", for example, such as to provide for better leverage in lifting weights (not shown) oriented along the first axis "A". The second grip surface 324*b* may, in some embodiments, permit a user to utilize a vertical transverse or "hammer" grip to lift the one or more weights coupled to the multi-use handle 320.

According to some embodiments, a third grip surface 324*c* may be formed between or by the second portion 320-3 and the interior grip area 322. According to some embodiments, the third grip surface 324*c* may comprise a horizontal surface or a surface oriented along or parallel to a third axis "E". The third grip surface 324*c* may be parallel to but offset vertically or planarly from the first grip surface 324*a* and/or may be perpendicular to the first axis "A". The third grip surface 324*c* may, in some embodiments, permit a user to utilize a horizontal transverse, pronated (overhand), or supinated (underhand) grip to lift the one or more weights coupled to the multi-use handle 320.

In some embodiments, a fourth grip surface 324*d* may be formed between or by the third portion 320-4 and the interior grip area 322. According to some embodiments, the fourth grip surface 324*d* may comprise an angled surface or a surface oriented along or parallel to a fourth axis "B". The fourth grip surface 324*d* may be oriented at an angle between ten degrees (10°) and fifty-five degrees (55°) with respect to the first axis "A", for example, such as to provide for better leverage in lifting weights (not shown) oriented along the first axis "A". According to some embodiments, the angle formed between the first axis "A" and the fourth axis "B" may be configured between fifteen degrees (15°) and twenty-five degrees (25°) for enhanced ergonomics while in some embodiments the angle may be configured between forty-five degrees (45°) and fifty-five degrees (55°) to enhance ease of height adjustability of an adjustable length, multi-segment, weighted trekking pole (not shown in FIG. 3; e.g., the adjustable length, multi-segment, weighted trekking pole system 100 of FIG. 1A and/or FIG. 1B herein) to which the multi-use handle 320 is coupled. According to some embodiments, the angle may be adjustable such as by providing a pivot pin (not shown) and/or other adjustment mechanism, e.g., at the junction of the upper shaft 112 and the upper angled portion 112-1. In such a manner, for example, the angle may be user-selectable and/or defined. According to some embodiments, either or both of the first portion 320-2 and the third portion 320-4 may be user-adjustable and/or contoured for enhanced ergonomics (e.g., as depicted). In some embodiments for example, the first portion 320-2 and/or the third portion 320-4 may hinge or pivot at their couplings with the neck 320-1 and/or at their respective couplings with the second portion 320-3. According to some embodiments, any end of the portions 320-2, 320-4 opposite the pivot point may be slidably-coupled to the neck 320-1 or second portion 320-3, as the case may be. In such a manner, for example, the angle formed between the first axis "A" and the second axis "A'" and/or the fourth axis "B" may be selectively varied while maintaining the enclosed nature of the interior grip area 322.

According to some embodiments, a strap 326 may be coupled to the multi-use handle 320 and/or the neck 320-1 thereof. According to some embodiments, the strap 326 may comprise a strip of rubber, fabric, cloth, and/or an adjustable lanyard coupled to the multi-use handle 320 and/or forming a loop via which, e.g., a user (not shown) may engage their wrist while holding the multi-use handle 320. According to some embodiments, the thicknesses of the various portions 320-2, 320-3, 320-4 that form the interior grip area 322 may be of various and/or varying thicknesses, shapes, and/or styles, as is or becomes known or practicable. One or more of the portions 320-2, 320-3, 320-4 may, for example, be configured as an ergonomic grip such as depicted.

In some embodiments, the multi-use handle 320 may comprise multiple surfaces 324*a-d* that a user may utilize to lift any attached weights (or to lift a pole without additional weights attached) with various different hand grips and orientations. In such a manner, for example, the user may target different muscles, reduce lifting strain, and/or gain additional stability simply by adjusting the user's grip between the various surfaces 324*a-d*. In some embodiments, the interior grip area 322 itself may provide additional stability and/or safety such as by shielding the user's knuckles from obstacles (similar to the guard on the hilt of a sword) and/or reducing the likelihood of the user dropping the pole/device coupled to the multi-use handle 320. In some embodiments, a strap (not shown) may be included to further reduce the likelihood of hand slippage or a user dropping the pole/device.

According to some embodiments, any or all of the components 320-1, 320-2, 320-3, 320-4, 322, 324*a-d*, 326 of the multi-use handle 320 may be similar in configuration and/or functionality to any similarly named and/or numbered components described herein. Fewer or more components 320-1, 320-2, 320-3, 320-4, 322, 324*a-d*, 326 (and/or portions thereof) and/or various configurations of the components 320-1, 320-2, 320-3, 320-4, 322, 324*a-d*, 326 may be included in the multi-use handle 320 without deviating from the scope of embodiments described herein. In some embodiments, one or more of the various components 320-1, 320-2, 320-3, 320-4, 322, 324*a-d*, 326 may not be needed and/or desired in the multi-use handle 320.

IV. Weights

Figure 4:
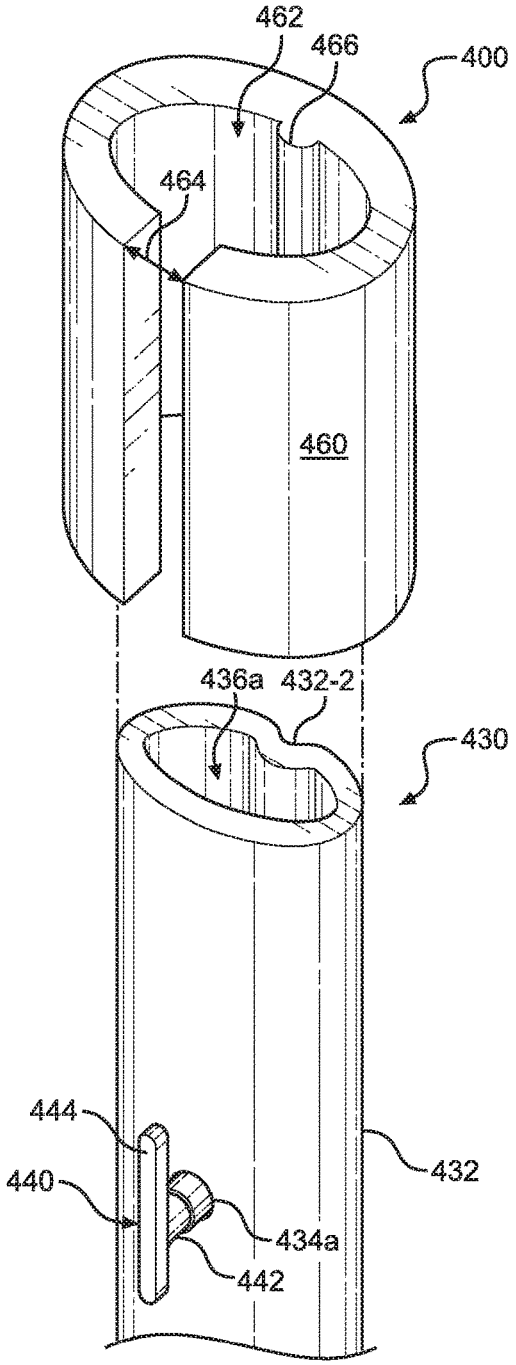
FIG. 4 is a partial left-front perspective view of an adjustable length, multi-segment, weighted trekking pole system according to some embodiments.

Turning now to FIG. 4, a partial left-front perspective view of an adjustable length, multi-segment, weighted trekking pole system 400 according to some embodiments is shown. In some embodiments, the weighted trekking pole system 400 may comprise a portion of a pole segment 430 such as a lower shaft 432. The lower shaft 432 may comprise a tube having a circular, rectangular, or oval cross-section (the latter being depicted for exemplary purposes in FIG. 4). In some embodiments, the lower shaft 432 may comprise or define a longitudinal detent or track 432-2, one or more mounting holes 434*a*, and/or may define an interior volume 436*a*. As depicted in FIG. 4, the cross-section of the lower shaft 432 may comprise a uniform shape (e.g., an oval as depicted) that is interrupted in the interior volume 436*a* by the longitudinal track 432-2.

According to some embodiments, the adjustable length, multi-segment, weighted trekking pole system 400 may comprise a spring pin 440 having a transverse shaft 442 disposed in the mounting hole 434*a* and/or a handle portion 444. The spring pin 440 may be utilized, for example, to selectively and/or removably couple the lower shaft 432 to another shaft (not shown). In some embodiments, the adjustable length, multi-segment, weighted trekking pole system 400 may comprise a removable, exterior-mounted, slotted annular weight 460. The slotted annular weight 460 may comprise a cylindrical body defining a bore 462 that defines an interior diameter larger than an exterior diameter of the lower shaft 432. In such a manner, for example, the slotted annular weight 460 may be slid onto the lower shaft 432 as a collar or sleeve. In some embodiments, the slotted annular weight 460 may comprise and/or define a slot 464 such as the longitudinal slot as shown in FIG. 4. According to some embodiments, the slot 464 may be oriented to align axially with the spring pin 440 (or handle portion 444 thereof) such that the slotted annular weight 460 may be fitted onto the lower shaft 432 without needing to remove the spring pin 440 (which may be fixed to the lower shaft 432).

In some embodiments, alignment of the slotted annular weight 460 may be facilitated or defined by alignment of a longitudinal projection or ridge 466 with the longitudinal track 432-2. The cross-sections of the lower shaft 432 and the slotted annular weight 460 may be operable to be nested or mated, for example, only in the case that the geometries align via coordination of the longitudinal ridge 466 with the longitudinal track 432-2. In such a manner, alignment of the slot 464 with the spring pin 440 may be readily obtained and/or once mated, the slotted annular weight 460 may maintain alignment and/or be more secure by continued engagement of the longitudinal ridge 466 with the longitudinal track 432-2. According to some embodiments, either or both of the longitudinal ridge 466 and the longitudinal track 432-2 may instead comprise other configurations of detents, voids, projections, and/or mating features (e.g., non-longitudinal features; a point feature) such as a track, notch, path, or detent and a corresponding nub, pin, or flange.

In some embodiments, any or all of the components 430, 432, 432-2, 434*a*, 436*a*, 440, 442, 444, 460, 462, 464, 466 of the adjustable length, multi-segment, weighted trekking pole system 400 may be similar in configuration and/or functionality to any similarly named and/or numbered components described herein. Fewer or more components 430, 432, 432-2, 434*a*, 436*a*, 440, 442, 444, 460, 462, 464, 466 (and/or portions thereof) and/or various configurations of the components 430, 432, 432-2, 434*a*, 436*a*, 440, 442, 444, 460, 462, 464, 466 may be included in the adjustable length, multi-segment, weighted trekking pole system 400 without deviating from the scope of embodiments described herein. In some embodiments, one or more of the various components 430, 432, 432-2, 434*a*, 436*a*, 440, 442, 444, 460, 462, 464, 466 may not be needed and/or desired in the adjustable length, multi-segment, weighted trekking pole system 400.

While various embodiments of adjustable length, multi-segment, weighted trekking pole systems are described herein, variations are contemplated to fall within the purview of some embodiments. While FIG. 1A and FIG. 1B depicted a two (2) segment pole and FIG. 2A and FIG. 2B depicted a three (3) segment pole, for example, different numbers and/or configurations of segments may be utilized in accordance with some embodiments. Similarly, while embodiments herein generally focus on spring pin and hole mounting systems, other configurations of mounting or coupling mechanisms may be utilized in accordance with some embodiments. In some embodiments for example, one or more of the rod or pole segments may comprise at threaded rod and one or more of the other rods or segments and/or weights may comprise threads operable to mate with the threaded rod.

Some embodiments herein may be associated with the term "approximately". As utilized herein, the term approximately generally refers to either a specifically-recited numerical value or a range of values that fall between plus or minus ten percent (10%) of the recited value. In the case that a particular value is recited without the qualifier of "approximately", it should be understood that, unless specifically limited, equivalents to such value are also contemplated and generally fall between plus or minus five percent (5%) of the recited value. Although specific quantities, values, and/or measurements are presented herein for purposes of example and ease of explanation, such quantities, values, and/or measurements are not limiting and equivalent, approximate, and/or different quantities, values, and/or measurements may be utilized without deviating from the scope of some embodiments.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicant currently intends to file additional applications to pursue patents for subject matter that has been disclosed and enabled but not claimed in the present application.

What is claimed is:

1. An adjustable length, multi-segment, weighted trekking pole, comprising:

an upper shaft segment comprising a first end and a second end, the second end comprising a male mating portion, and comprising a plurality of upper mounting holes transverse to the upper shaft segment and disposed between the first end and the second end of the upper shaft segment;

a handle portion coupled to the first end of the upper shaft segment;

a lower shaft segment comprising a first end and a second end, the first end comprising a ground-engaging portion and the second end comprising a female mating portion, and comprising a lower mounting hole transverse to the lower shaft segment and disposed between the first end and the second end of the lower shaft segment, the male mating portion being disposed through the female mating portion and into an interior passage of the lower shaft segment;

a mounting pin extending radially through the lower mounting hole of the lower shaft segment and through an aligned and corresponding first one of the upper mounting holes of the upper shaft segment; and at least one slotted annular and removable weight defining an interior passage through which the lower shaft segment is disposed, wherein the at least one slotted annular and removable weight comprises a water bottle.

2. The adjustable length, multi-segment, weighted trekking pole of claim 1, wherein the at least one slotted annular and removable weight rests upon an exterior flange of the lower shaft segment.

3. The adjustable length, multi-segment, weighted trekking pole of claim 1, wherein the handle portion comprises a multi-use grip portion comprising a plurality of gripping surfaces, each gripping surface oriented along a different axis.

4. The adjustable length, multi-segment, weighted trekking pole of claim 3, wherein a first one of the plurality of gripping surfaces is oriented along a first axis parallel and planarly offset from an orientation of the upper shaft segment.

5. The adjustable length, multi-segment, weighted trekking pole of claim 4, wherein a second one of the plurality of gripping surfaces is oriented along a second axis perpendicular to the first axis.

6. The adjustable length, multi-segment, weighted trekking pole of claim 5, wherein a third one of the plurality of gripping surfaces is oriented along a third axis that is angled between ten degrees (10°) and fifteen degrees (15°) from the first axis.

7. The adjustable length, multi-segment, weighted trekking pole of claim 1, wherein the lower shaft segment comprises a longitudinal track disposed on an exterior surface thereof and wherein the interior passage of the at least one slotted annular and removable weight comprises a corresponding longitudinal ridge disposed to travel within the longitudinal track.

8. The adjustable length, multi-segment, weighted trekking pole of claim 1, wherein the mounting pin is biased through the lower mounting hole of the lower shaft segment and through the aligned and corresponding first one of the upper mounting holes of the upper shaft segment by a biasing element.

9. An adjustable length, multi-segment, weighted trekking pole, comprising:

an upper shaft segment comprising a first end and a second end, the second end comprising a first female mating portion, and comprising an upper mounting hole transverse to the upper shaft segment and disposed between the first end and the second end of the upper shaft segment;

a handle portion coupled to the first end of the upper shaft segment;

a lower shaft segment comprising a first end and a second end, the first end comprising a ground-engaging portion and the second end comprising a second female mating portion, and comprising a lower mounting hole transverse to the lower shaft segment and disposed between the first end and the second end of the lower shaft segment;

a middle shaft segment comprising a first end and a second end, the first end comprising a first male mating portion and the second end comprising a second male mating portion, and comprising a plurality of middle mounting holes transverse to the middle shaft segment and disposed between the first end and the second end of the middle shaft segment, the first male mating portion being disposed through the first female mating portion and into an upper interior passage of the upper shaft segment and the second male mating portion being disposed through the second female mating portion and into a lower interior passage of the lower shaft segment;

a first mounting pin extending radially through the upper mounting hole of the upper shaft segment and through an aligned and corresponding first one of the middle mounting holes of the middle shaft segment;

a second mounting pin extending radially through the lower mounting hole of the lower shaft segment and through an aligned and corresponding second one of the middle mounting holes of the middle shaft segment; and at least one slotted annular and removable weight defining an interior passage through which the lower shaft segment is disposed.

10. The adjustable length, multi-segment, weighted trekking pole of claim 9, wherein the at least one slotted annular and removable weight rests upon an exterior flange of the lower shaft segment.

11. The adjustable length, multi-segment, weighted trekking pole of claim 9, wherein the at least one slotted annular and removable weight comprises a water bottle.

12. The adjustable length, multi-segment, weighted trekking pole of claim 9, wherein the handle portion comprises a multi-use grip portion comprising a plurality of gripping surfaces, each gripping surface oriented along a different axis.

13. The adjustable length, multi-segment, weighted trekking pole of claim 12, wherein a first one of the plurality of gripping surfaces is oriented along a first axis parallel and planarly offset from an orientation of the upper shaft segment.

14. The adjustable length, multi-segment, weighted trekking pole of claim 13, wherein a second one of the plurality of gripping surfaces is oriented along a second axis perpendicular to the first axis.

15. The adjustable length, multi-segment, weighted trekking pole of claim 14, wherein a third one of the plurality of gripping surfaces is oriented along a third axis that is angled between ten degrees (10°) and fifteen degrees (15°) from the first axis.

16. The adjustable length, multi-segment, weighted trekking pole of claim 9, wherein the lower shaft segment comprises a longitudinal track disposed on an exterior surface thereof and wherein the interior passage of the at least one slotted annular and removable weight comprises a corresponding longitudinal ridge disposed to travel within the longitudinal track.

17. The adjustable length, multi-segment, weighted trekking pole of claim 9, wherein at least one of the mounting pins is biased through the respective mounting holes by a biasing element.

18. An adjustable length, multi-segment, weighted trekking pole, comprising:

an upper shaft segment comprising a first end and a second end, the second end comprising a male mating portion, and comprising a plurality of upper mounting holes transverse to the upper shaft segment and disposed between the first end and the second end of the upper shaft segment;

a handle portion coupled to the first end of the upper shaft segment;

a lower shaft segment comprising a first end and a second end, the first end comprising a ground-engaging portion and the second end comprising a female mating portion, and comprising a lower mounting hole transverse to the lower shaft segment and disposed between the first end and the second end of the lower shaft segment, the male mating portion being disposed through the female mating portion and into an interior passage of the lower shaft segment, wherein the lower shaft segment comprises a longitudinal track disposed on an exterior surface thereof and wherein the interior passage of the at least one slotted annular and removable weight comprises a corresponding longitudinal ridge disposed to travel within the longitudinal track;

a mounting pin extending radially through the lower mounting hole of the lower shaft segment and through an aligned and corresponding first one of the upper mounting holes of the upper shaft segment; and at least one slotted annular and removable weight defining an interior passage through which the lower shaft segment is disposed.

19. The adjustable length, multi-segment, weighted trekking pole of claim 18, wherein the at least one slotted annular and removable weight rests upon an exterior flange of the lower shaft segment.

20. The adjustable length, multi-segment, weighted trekking pole of claim 18, wherein the mounting pin is biased through the lower mounting hole of the lower shaft segment and through the aligned and corresponding first one of the upper mounting holes of the upper shaft segment by a biasing element.

* * * * *